US009261055B2

(12) United States Patent
Tsumoto et al.

(10) Patent No.: US 9,261,055 B2
(45) Date of Patent: Feb. 16, 2016

(54) CANISTER MODULE

(71) Applicant: DENSO CORPORATION, Kariya, Aichi-pref. (JP)

(72) Inventors: Koji Tsumoto, Kuwana (JP); Yasuo Kato, Niwa-gun (JP)

(73) Assignee: DENSO CORPORATION, Kariya (JP)

( * ) Notice: Subject to any disclaimer, the term of this patent is extended or adjusted under 35 U.S.C. 154(b) by 176 days.

(21) Appl. No.: 14/262,856

(22) Filed: Apr. 28, 2014

(65) Prior Publication Data

US 2014/0331976 A1 Nov. 13, 2014

(30) Foreign Application Priority Data

May 7, 2013 (JP) ..... 2013-97716

(51) Int. Cl.
*F02M 33/02* (2006.01)
*F02M 25/08* (2006.01)

(52) U.S. Cl.
CPC ..... *F02M 25/0836* (2013.01); *F02M 25/0854* (2013.01); *F02M 2025/0845* (2013.01)

(58) Field of Classification Search
CPC ..... F02M 2025/0845; F02M 25/0836; F02M 25/0854
USPC ..... 123/519
See application file for complete search history.

(56) References Cited

U.S. PATENT DOCUMENTS 4,318,383 A * 3/1982 Iritani ..... F02M 25/0836 123/520
6,390,073 B1 * 5/2002 Meiller ..... F02M 25/0836 123/510
2001/0017360 A1 8/2001 Watanabe et al.
2002/0104979 A1 8/2002 Kato
2003/0074958 A1 * 4/2003 Nagasaki ..... F02M 25/0818 73/114.41
2003/0089345 A1 * 5/2003 Itou ..... F02M 25/0836 123/520
2004/0055583 A1 * 3/2004 Everingham ..... F02M 25/0836 123/520
2007/0240690 A1 10/2007 Nanba (Continued)

FOREIGN PATENT DOCUMENTS

JP 2001-227671 A 8/2001
JP 2002-235866 A 8/2002
JP 2007-285311 A 11/2007
JP 2010-127389 A 6/2010
JP 2011-238680 A 11/2011

OTHER PUBLICATIONS

Office Action issued Jul. 2, 2015 in corresponding JP Application No. 2013-97716.

*Primary Examiner* — Marguerite McMahon
*Assistant Examiner* — Tea Holbrook

(57) ABSTRACT

A tank passage communicates a canister housing with a fuel tank. A purge passage communicates the canister housing with an intake air system. An atmospheric air passage communicates the canister housing with an atmosphere. A valve housing accommodating a valve element is located in a recessed portion defined with a first inner wall and a second inner wall. A seal member is located on a radially outside of the valve housing to seal the recessed portion. The first inner wall has a first opening to communicate the canister housing with the recessed portion. The second inner wall has a second opening to communicate the recessed portion with the atmospheric air passage. The first opening or the second opening is defined around a valve seat. The valve element is seated on and lifted from the valve seat to control communication between the canister housing and the atmospheric air passage.

4 Claims, 5 Drawing Sheets

(56) References Cited

U.S. PATENT DOCUMENTS

2008/0223343 A1* 9/2008 Ammermann ..... F02M 25/0854 123/520
2009/0101119 A1* 4/2009 Ammermann ..... F02M 25/0854 123/519
2010/0163115 A1* 7/2010 Kaneda ..... F02M 25/0854 137/315.01

* cited by examiner

CANISTER MODULE

CROSS REFERENCE TO RELATED APPLICATION

This application is based on reference Japanese Patent Application No. 2013-97716 filed on May 7, 2013, the disclosure of which is incorporated herein by reference.

TECHNICAL FIELD

The present disclosure relates to a canister module.

BACKGROUND

A conventionally known canister module is configured to recover fuel vapor, which is caused in a fuel tank, and to release the recovered fuel vapor into an intake air system of an internal combustion engine. The canister module may include a canister, an atmospheric air passage member, a solenoid valve, and/or the like. The canister accommodates an adsorption material. The atmospheric air passage member forms an atmospheric air passage to draw air into an interior of the canister. The solenoid valve is configured to communicate the atmospheric air passage with the interior of the canister and to block the atmospheric air passage from the interior of the canister. The canister module is configured to supply air-fuel mixture into the internal combustion engine. The air-fuel mixture is a mixture of air, which is drawn through the atmospheric air passage, and fuel, which is adsorbed in the adsorption material. The canister module supplies the air-fuel mixture according to an operation state of the internal combustion engine. For example, Patent Document 1 discloses a solenoid valve equipped between a canister and an atmospheric air passage member. In Patent Document 1, the solenoid valve communicates, the interior of the canister with the atmospheric air passage and to block the interior of the canister from the atmospheric air passage. Patent Document 2 discloses a solenoid valve accommodated in a canister, which is formed integrally with an atmospheric air passage member. In Patent Document 2, the solenoid valve communicates the interior of the canister, which accommodates an adsorption material, with the atmospheric air passage and to block the interior of the canister from the atmospheric air passage.

(Patent Document 1)

Publication of unexamined Japanese patent application No. 2001-227671

(Patent Document 2)

Publication of unexamined Japanese patent application No. 2002-235866

It is noted that, in the canister module, which employs the solenoid valve according to Patent Document 1, the canister and the atmospheric air passage member are equipped separately. Therefore, the configuration of Patent Document 1 includes a fitting portion, at which the solenoid valve is fitted to the canister, and a fitting portion, at which the solenoid valve is fitted to the atmospheric air passage member. Accordingly, in the configuration of Patent Document 1, seal members are equipped at the two fitting portions in order to secure an airtight property between the interior of the canister, which accommodates the adsorption material, from the atmosphere. It is further noted that, in the canister module, which employs the solenoid valve according to Patent Document 2, the solenoid valve is equipped in a recessed portion formed in the canister. In addition, an interior of the canister, which accommodates an adsorption material, communicates with the atmospheric air passage through the recessed portion. Therefore, the configuration of Patent Document 2 includes a fitting portion, at which the solenoid valve is fitted to the canister, and a fitting portion, at which the solenoid valve is fitted to the recessed portion. Accordingly, in the configuration of Patent Document 2, seal members are equipped at the two fitting portions. As described above, each of the configurations of Patent Document 1 and Patent Document 2 is equipped with multiple seal members. Therefore, in each of the configurations of Patent Document 1 and Patent Document 2, an airtight property of the interior of the canister, which accommodates an adsorption material, may not be secured sufficiently.

SUMMARY

It is an object of the present disclosure to produce a canister module including a canister having an enhanced airtight property with a reduced component.

According to an aspect of the present disclosure, a canister module is configured to supply fuel vapor, which is caused in a fuel tank, to an internal combustion engine. The canister module comprises a canister housing having a tank passage and a purge passage. The tank passage is configured to communicate with the fuel tank. The purge passage is configured to communicate with an intake air system. The intake air system is configured to supply air-fuel mixture, which is mixture of air and fuel, to the internal combustion engine. The canister module further comprises an atmospheric air passage member defining an atmospheric air passage configured to communicate an interior of the canister housing with an atmosphere. The canister module further comprises an adsorption material accommodated in the interior of the canister housing and configured to adsorb fuel vapor. The canister module further comprises a valve housing located in a recessed portion, which is defined in the canister housing. The canister module further comprises a valve element movable in the valve housing. The canister module further comprises a coil configured to generate a magnetic field when being energized. The canister module further comprises a moving core connected with the valve element and movable in an axial direction of the valve housing. The canister module further comprises a stationary core configured to draw the moving core with the magnetic field generated by the coil. The canister module further comprises a seal member located on a radially outside of the valve housing and configured to seal the recessed portion air-tightly from the atmosphere. The recessed portion is defined with a first inner wall and a second inner wall. The first inner wall has a first opening configured to communicate the interior of the canister housing with the recessed portion. The second inner wall has a second opening configured to communicate the recessed portion with the atmospheric air passage. The first opening or the second opening is defined around a periphery forming a valve seat. The valve element is configured to make contact with the valve seat and to be spaced from the valve seat to communicate the interior of the canister housing with the atmospheric air passage and to block the interior of the canister housing from the atmospheric air passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

As follows, embodiments of the present disclosure will be described with reference to drawings.

First Embodiment

Figure 1:
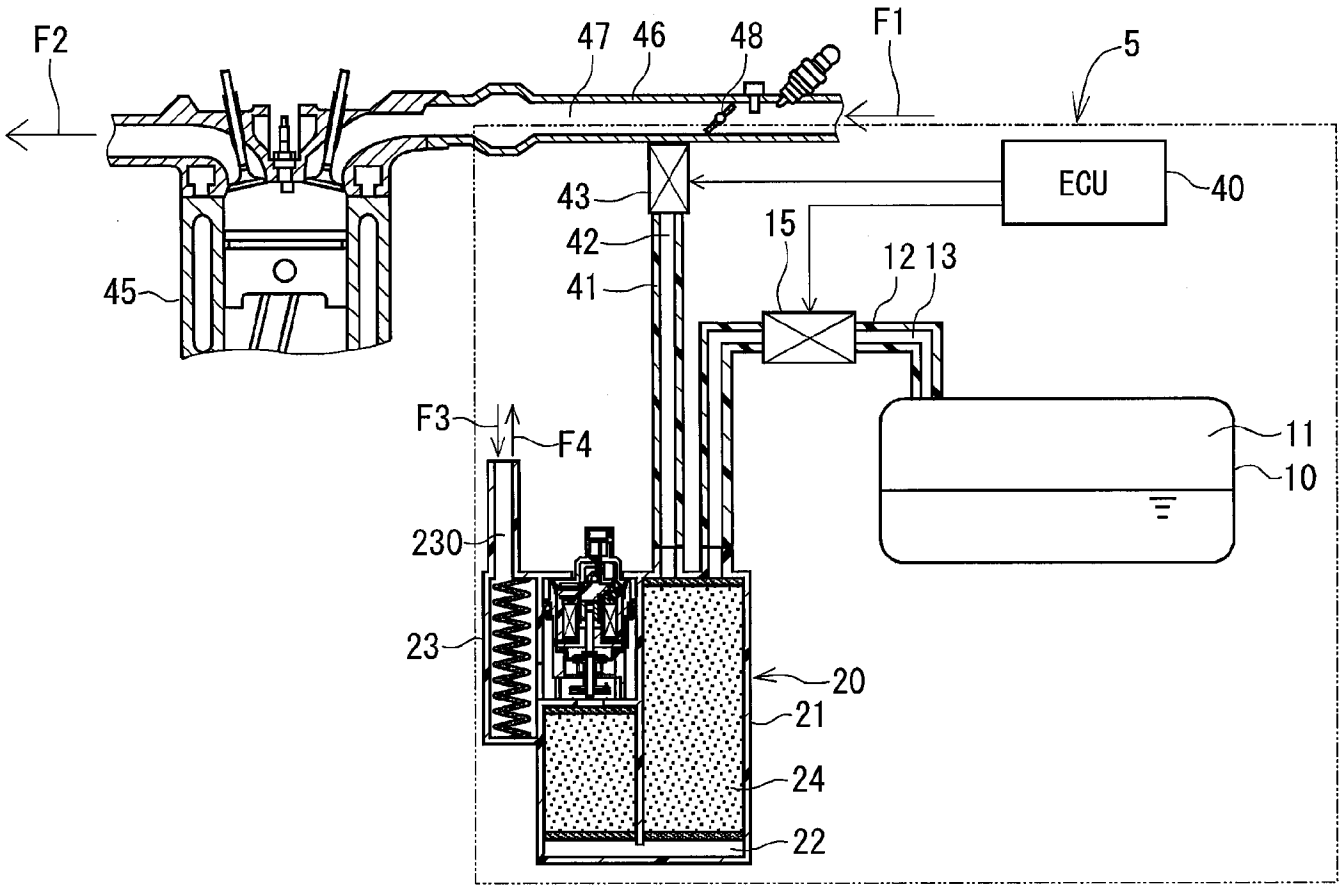
FIG. 1 is a schematic view showing a vapor fuel processing system including a canister module according to a first embodiment of the present disclosure.

FIG. 1 shows a vapor fuel processing system employing a canister module according to a first embodiment of the present disclosure. A vapor fuel processing system 5 includes a fuel tank 10, a canister module 20, an ECU 40, and/or the like. In the vapor fuel processing system 5, the canister module 20 recovers fuel vapor caused in an interior 11 of the fuel tank 10. The canister module 20 purges recovered fuel vapor into an intake passage 47. The intake passage 47 is formed in an intake pipe 46, which is connected to an engine 45. The engine 45 may be one example of an internal combustion engine. The intake passage 47 may be one example of an intake air system. In FIG. 1, arrows F1, F2, F3, and F4 show a flow of intake air supplied to the engine 45, a flow of exhaust gas exhausted from the engine 45, a flow of air drawn into the canister module 20, and a flow of air (gas) exhausted from the canister module 20, respectively.

The fuel tank 10 is connected with the canister module 20 through a first communicating tube 12. The fuel tank 10 stores fuel to be supplied to the engine 45. The first communication pipe 12 forms a first communication passage 13. The first communication passage 13 is configured to communicate the interior 11 of the fuel tank 10 with an interior of a canister housing 21 of the canister module 20. A tank blockade valve 15 is equipped to the first communication pipe 12. The tank blockade valve 15 is configured to communicate the interior 11 of the fuel tank 10 with the interior of the canister housing 21 and to block the interior 11 of the fuel tank 10 from the interior of the canister housing 21, according to an instruction from the ECU 40.

The canister module 20 includes a canister adsorption material 24, which recovers fuel vapor caused in the interior 11 of the fuel tank 10. The canister module 20 is connected with the intake pipe 46 through a second communication pipe 41. The canister module 20 includes an atmospheric air passage member 23. The atmospheric air passage member 23 forms an atmospheric air passage 230 configured to communicate the interior of the canister housing 21 with the atmosphere. The configuration of the canister module 20 will be described later in detail.

The second communication pipe 41 forms a second communication passage 42. The second communication pipe 41 is equipped with a purge valve 43. The purge valve 43 is configured to communicate the interior of the canister housing 21 with the intake passage 47 and to block the canister housing 21 from the intake passage 47 according to an instruction from the ECU 40.

The ECU 40 includes, for example, a microcomputer configured with a CPU, a RAM, a ROM and/or the like. The CPU may function as a computation unit. The RAM and/or the ROM may function as a storage unit. The ECU 40 is electrically connected with the tank blockade valve 15 and the purge valve 43. The ECU 40 opens and closes the tank blockade valve 15 according to a traveling state of the vehicle, thereby to control communication and blockade between the interior 11 of the fuel tank 10 and the interior of the canister housing 21. The ECU 40 further opens and closes the purge valve 43 according to the traveling state of the vehicle. The present configuration enables to cause atmospheric air, which flows through the atmospheric air passage 230 into the canister housing 21, to entrain fuel, which is adsorbed by the canister adsorption material 24. The entrained fuel is supplied through the second communication passage 42 into the intake passage 47, which is located downstream of a throttle valve 48.

Figure 2:
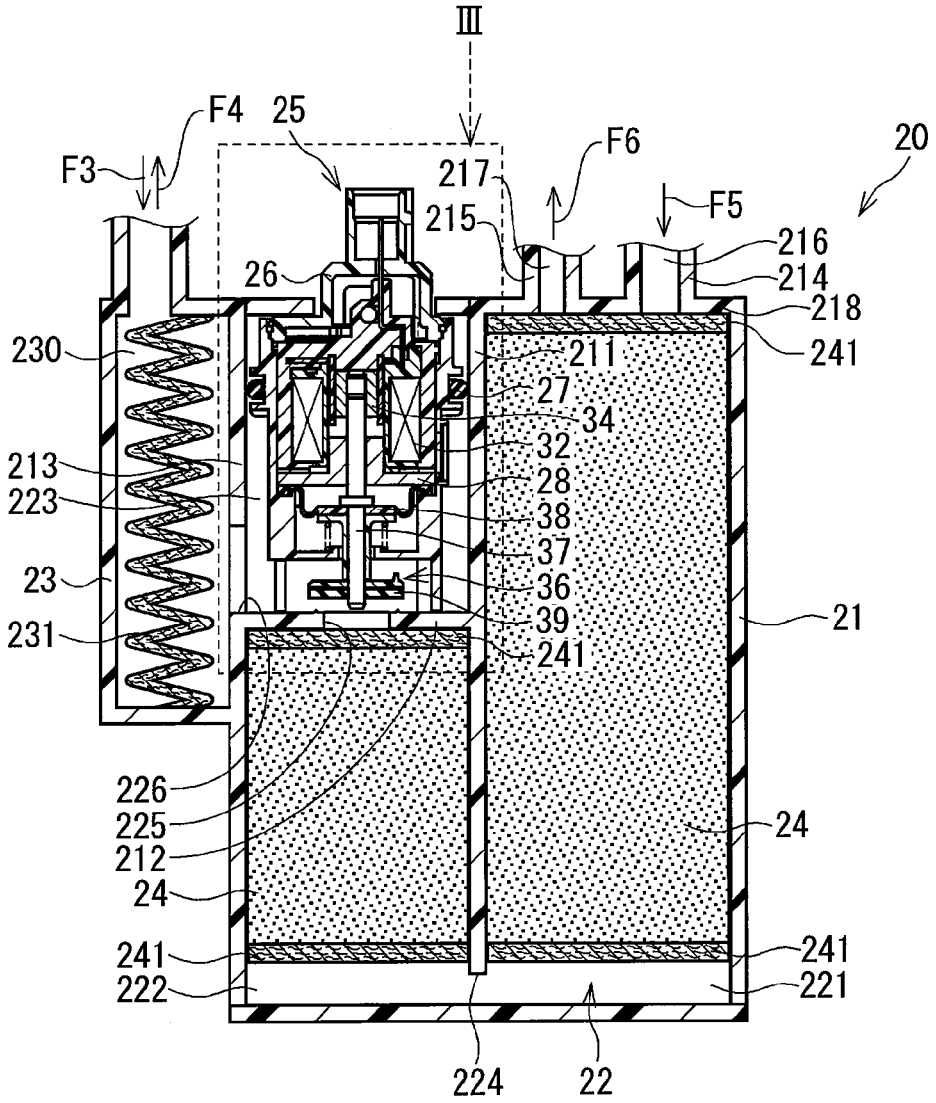
FIG. 2 is a sectional view showing the canister module according to the first embodiment of the present disclosure.

Subsequently, the configuration of the canister module 20 will be described with reference to FIG. 2 and FIG. 3. The canister module 20 includes the canister housing 21, the canister adsorption material 24, the atmospheric air passage member 23, a solenoid valve 25, and/or the like. In FIG. 2, arrows F3, F4, F5, and F6 show a flow of air drawn into the canister module 20, a flow of air exhausted from the canister module 20, a flow of fuel vapor and air from the fuel tank 10, and a flow of fuel vapor and air from the canister module 20 to the intake pipe 46, respectively.

The canister housing 21 is formed substantially in a hollow rectangular parallelepiped shape. The canister housing 21 includes a first partition 211 and a second partition (first inner wall) 212. The first partition 211 and the second partition 212 partitions the interior of the canister housing 21.

The first partition 211 is equipped substantially at a center of the canister housing 21 in its longitudinal direction. The first partition 211 partitions the interior of the canister housing 21 into a first partitioned chamber 221, a second partitioned chamber 222, and a third partitioned chamber 223. The first partition 211 includes a communication passage 224. The communication passage 224 communicates the first partitioned chamber 221 with the second partitioned chamber 222.

The second partition 212 is located at one of the spaces partitioned by the first partition 211. The second partition 212 is connected with the first partition 211 and an inner wall surface of the canister housing 21. The second partition 212 partitions the one space, which is partitioned by the first partition 211, into the second partitioned chamber 222 and the third partitioned chamber 223. The second partition 212 has a first opening 225. The first opening 225 communicates the second partitioned chamber 222 with the third partitioned chamber 223.

The canister housing 21 has an outer wall (second inner wall) 213, which forms the third partitioned chamber 223. The outer wall 213 is equipped with the atmospheric air passage member 23. In the canister module 20 according to the first embodiment, the canister housing 21 and the atmospheric air passage member 23 are integrally formed with each other. The outer wall 213 has a second opening 226. The second opening 226 communicates the third partitioned chamber 223 with the atmospheric air passage 230, which is formed in the atmospheric air passage member 23. The third partitioned chamber 223 may function as an interior of a recessed portion.

The outer wall of the canister housing 21 forms the first partitioned chamber 221. The outer wall of the canister housing 21 includes an outer wall 218. The outer wall 218 is located at a position distant from the communication passage 224. The outer wall 218 is equipped with a tank pipe 214 and a purge pipe 215. The tank pipe 214 is connected with the first communication pipe 12. The purge pipe 215 is connected with the second communication pipe 41. The tank pipe 214 forms a tank passage 216. The tank passage 216 communicates through the first communication passage 13 with the interior 11 of the fuel tank 10. The purge pipe 215 forms a purge passage 217. The purge passage 217 communicates through the second communication passage 42 with the intake passage 47.

The canister adsorption material 24 is formed of, for example, activated carbon. The canister adsorption material 24 is accommodated in the first partitioned chamber 221 and the second partitioned chamber 222. A filter 241 is formed of a nonwoven fabric. The filter 241 is equipped to an end of the canister adsorption material 24 on the side of the communication passage 224, an end of the canister adsorption material 24 on the side of the first opening 225, and end of the canister adsorption material 24 on the side of the outer wall 218. The filter 241 is equipped to restrict the canister adsorption material 24 from spreading through the ends.

The atmospheric air passage member 23 is connected to the outer wall 213 of the canister housing 21. The atmospheric air passage member 23 forms the atmospheric air passage 230. The atmospheric air passage 230 is equipped with a filter 231. The filter 231 is formed of, for example, a nonwoven fabric in a bellows form. The filter 231 screens foreign matter included in air when the canister module 20 draws external air into the second partitioned chamber 222 and the first partitioned chamber 221.

The solenoid valve 25 includes a valve housing 26, a stationary core 28, a coil 32, a moving core 34, a valve element 36, and/or the like. The solenoid valve 25 is accommodated in the third partitioned chamber 223 of the canister housing 21.

The valve housing 26 is formed substantially in a bottomed tubular shape. The valve housing 26 is formed such that an interior of the valve housing 26 is configured to communicate through the first opening 225 with the second partitioned chamber 222. The valve housing 26 has one end 262 on the side of an opening 261. In the state where the solenoid valve 25 is accommodated in the third partitioned chamber 223, the one end 262 is in contact with a wall surface 227 of the second partition 212. The wall surface 227 of the second partition 212 is located on the side of the third partitioned chamber 223. The one end 262 has an opening 267 on the side of the second opening 226. The opening 267 communicates the interior of the valve housing 26 with the third partitioned chamber 223. The other end 263 is blocked. The other end 263 is equipped with a terminal 264. The terminal 264 has a terminal end 265, which is electrically connected with an external electric power unit (not shown).

The valve housing 26 has an outer wall 266 on the radially outside. The outer wall 266 is equipped with a seal member 27. The first partition 211 has a wall surface 228 on the side of the third partitioned chamber 223. The outer wall 213 has a wall surface 229 on the side of the third partitioned chamber 223. In the state where the solenoid valve 25 is accommodated in the third partitioned chamber 223, the seal member 27 is in contact with the wall surface 228 of the first partition 211 and the wall surface 229 of the outer wall 213. The present configuration enables to seal the space of the third partitioned chamber 223, which is located on the side of the second partitioned chamber 222 relative to the seal member 27, air-tightly from the external space.

The stationary core 28 is a tubular metallic member. The stationary core 28 is accommodated in the valve housing 26 and located substantially at a center of the valve housing 26. The stationary core 28 includes a tubular portion 281, a dish portion 282, and/or the like. The tubular portion 281 is located substantially at the center of the valve housing 26. The dish portion 282 is connected to one end of the tubular portion 281. The dish portion 282 is fixed to the inner wall of the valve housing 26. A through hole 283 is formed along an axial direction of the stationary core 28.

The coil 32 is wound around a bobbin 321. The coil 32 is located on the radially outer side of the tubular portion 281 of the stationary core 28. A yoke 322 is equipped on the radially outer side of the coil 32. The coil 32 is electrically connected through an electric wiring inside the yoke 322 with the terminal end 265 of the terminal 264.

The moving core 34 is a tubular metallic member. The moving core 34 is located inside the valve housing 26. The moving core 34 is located on the side of the terminal 264. The moving core 34 is located on the radially inner side of the bobbin 321. The moving core 34 is movable back and forth in the axial direction of the valve housing 26. The moving core 34 has a through hole 341.

The valve element 36 includes a shaft 37, a diaphragm 38, a valve element 39, and/or the like.

The shaft 37 is a substantially cylindrical member. The shaft 37 is movable back and forth in the axial direction of the valve housing 26. The shaft 37 includes a middle-diameter portion 371, a large diameter portion 372, a small diameter portion 373, and/or the like.

The middle-diameter portion 371 is located in the valve housing 26. The middle-diameter portion 371 is located on the side of the terminal 264. One end of the middle-diameter portion 371 is inserted into the through hole 341 of the moving core 34 and connected with the moving core 34. The middle-diameter portion 371 is extended from the moving core 34 toward the second partition 212. The middle-diameter portion 371 is inserted into the through hole 283 of the stationary core 28.

The large diameter portion 372 is connected to a portion of the middle-diameter portion 371 on the side of the second partition 212. The outer diameter of the large diameter portion 372 is greater than the outer diameter of the middle-diameter portion 371.

The small diameter portion 373 is connected to a portion of the large diameter portion 372 on the side of the second partition 212. The small diameter portion 373 is equipped with a retainer 374 on the radially outside. The retainer 374 is substantially in a tubular shape. The retainer 374 and the large diameter portion 372 support a substantially center of the diaphragm 38.

The diaphragm 38 is a membrane member. The diaphragm 38 is fixed to an inner wall of the valve housing 26 at its radially outer end. The diaphragm 38 maintains an airtight state of a valve chamber 381. The valve chamber 381 is formed in the valve housing 26 on the side of the second partition 212.

A spring 382 is in contact with the retainer 374 at one end. The spring 382 is in contact with the inner wall of the valve housing 26 at the other end. The spring 382 biases the valve element 36 in a direction to be apart from the second partition 212.

The valve element 39 is an annular member formed of an elastic material, such as a rubber material. The valve element 39 is supported at an end of the small diameter portion 373 of the shaft 37. A projection 391 is projected from the wall surface 227 of the second partition 212. More specifically, the projection 391 is projected from a periphery of the wall surface 227 defining the first opening 225. The valve element 39 is configured to make contact with the projection 391. The projection 391 may function as a valve seat.

Regulating members 271 and 272 are connected to the first partition 211. The solenoid valve 25 is accommodated in the third partitioned chamber 223. In the present state, the outer wall 213 of the valve housing 26 and the regulating members 271 and 272 regulate movement of the solenoid valve 25 relative to the valve housing 26.

Subsequently, an operation of the canister module 20 will be described.

Figure 3:
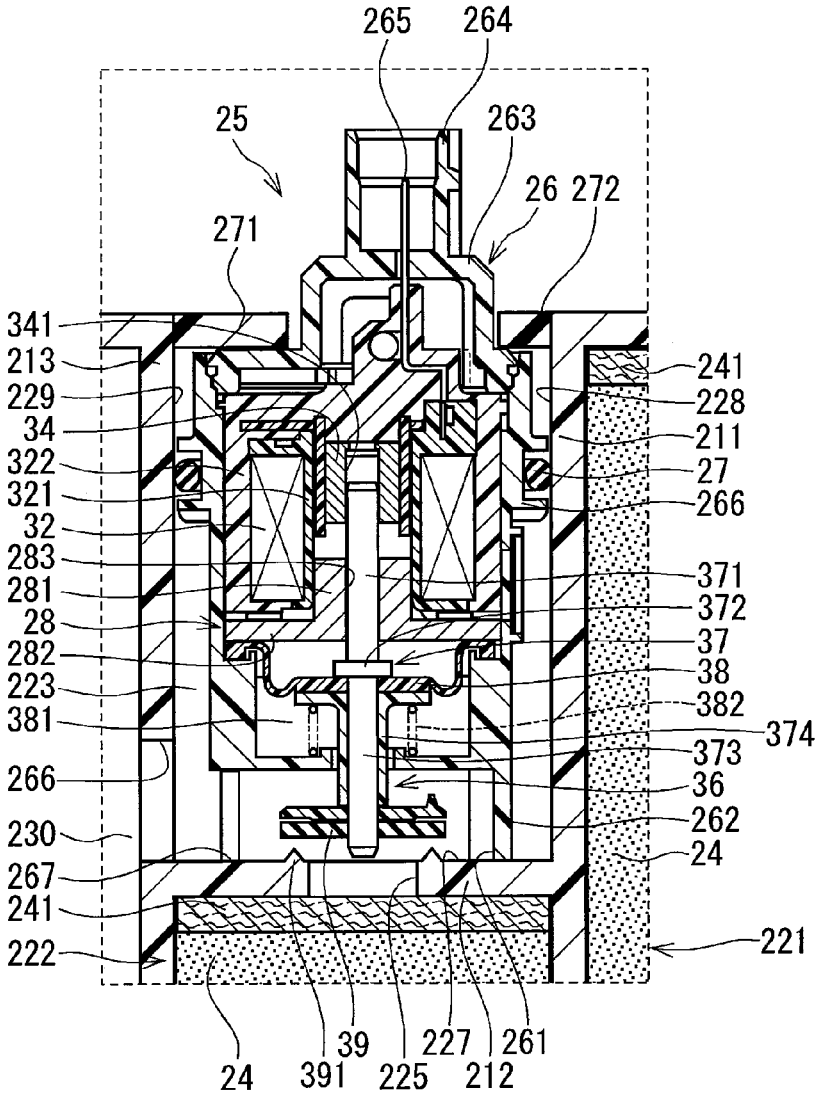
FIG. 3 is an enlarged view showing a section enclosed by dotted box III in FIG. 2.

As shown in FIG. 3, in the solenoid valve 25 of the canister module 20, when electric power is not supplied to the coil 32, the valve element 39 is lifted from the projection 391. In the present state, the second partitioned chamber 222 communicates with the atmosphere through the first opening 225, the valve chamber 381, the opening 267, the third partitioned chamber 223, the second opening 226, and the atmospheric air passage 230. When fuel vapor caused in the interior 11 of the fuel tank 10 is absorbed in the canister adsorption material 24, air flows together with the fuel vapor into the first partitioned chamber 221 and the second partitioned chamber 222, and the air is released to the atmosphere. When the canister adsorption material 24 has adsorbed fuel vapor for a certain quantity, the purge valve 43 opens. Thus, negative pressure caused in the intake passage 47 is utilized to draw air through the atmospheric air passage 230 into the first partitioned chamber 221 and the second partitioned chamber 222. Thus, fuel vapor absorbed in the canister adsorption material 24 flows together with the drawn air through the second communication passage 42 and the intake passage 47 into the engine 45.

When electric power is supplied to the coil 32, a magnetic circuit is formed around the coil 32. The magnetic circuit generates a magnetic attractive force between the stationary core 28 and the moving core 34. Thus, the moving core 34 moves toward the stationary core 28. As the moving core 34 moves toward the stationary core 28, the shaft 37 connected to the moving core 34 also moves toward the second partition 212. Thus, the valve element 39 connected to the shaft 37 makes contact with the projection 391. When the valve element 39 makes contact with the projection 391, the second partitioned chamber 222 is blocked for the valve chamber 381. in this way, the first partitioned chamber 221 and the second partitioned chamber 222 are air-tightly sealed from the atmosphere steadily.

(a) In the canister module 20 according to the first embodiment, the solenoid valve 25 is accommodated in the third partitioned chamber 223 of the canister housing 21. The third partitioned chamber 223 is formed by a wall member including the second partition 212. The second partition 212 has the first opening 225. The first opening 225 is configured to communicate the third partitioned chamber 223 with the second partitioned chamber 222 and the third partitioned chamber 223. The second partitioned chamber 222 and the third partitioned chamber 223 accommodate the canister adsorption material 24. The third partitioned chamber 223 is formed by the wall member including the outer wall 213. The outer wall 213 is connected with the atmospheric air passage member 23. The atmospheric air passage member 23 has the second opening 226. The second opening 226 communicates with the third partitioned chamber 223 and the atmospheric air passage 230. The seal member 27 is equipped to the outer wall 266 of the valve housing 26. The seal member 27 airtightly seals the third partitioned chamber 223 from the external space. The seal member 27, which is a single component, air-tightly seals the first partitioned chamber 221 and the second partitioned chamber 222 from the atmosphere. The projection 391 is formed around the periphery of the first opening 225. The valve element 39 of the solenoid valve 25 is configured to make contact with the projection 391 and to be lifted from the projection 391. In this way, the valve element 39 is configured to communicate the second partitioned chamber 222 with the atmospheric air passage 230 and to block the second partitioned chamber 222 from the atmospheric air passage 230. With the present configuration, the canister module 20 according to the first embodiment is enabled to seal the first partitioned chamber 221 and the second partitioned chamber 222 from the atmosphere airtightly with a less seal member, i.e., with a reduced seal member. Therefore, the present configuration enables to reduce a portion, through which fuel vapor absorbed in the canister adsorption material 24 may leak to the atmosphere. Thus, the airtight property of the canister module 20 can be enhanced.

(b) In addition, according to the presently disclosed configuration, the seal member being a single component maintains the airtight property of the first partitioned chamber 221 and the second partitioned chamber 222 from the atmosphere. Therefore, the present structure enables to reduce the number of components of the canister module 20, compared with a configuration in which multiple seal members are used to maintain an airtight property of the interior of the canister, which accommodates the adsorption material, from the atmosphere.

(c) According to the present disclosure, the projection 391 is formed on the second partition 212 to which the valve element 39 is configured to make contact. The present configuration enables further to enhance the airtight property of the first partitioned chamber 221 and the second partitioned chamber 222 from the atmosphere.

(d) In the canister module 20, the seal member 27 being a sole component is in contact with the wall surface 228 of the first partition 211 and the wall surface 229 of the outer wall 213. The wall surface 228 is on the side of the third partitioned chamber 223. The wall surface 229 is on the side of the third partitioned chamber 223. That is, both the wall surface 228 and the wall surface 229 are opposed to the third partitioned chamber 223. Thus, the sole seal member 27 is fixed to the third partitioned chamber 223. The present configuration enables to mount the solenoid valve 25 to the canister housing 21 with less assembly load, compared with a configuration in which a solenoid valve is mounted to a canister housing with multiple seal members.

(e) The canister module 20 includes the regulating members 271 and 272 configured to regulate movement of the solenoid valve 25, which is accommodated in the third partitioned chamber 223. The present configuration enables to restrict the valve element 39 of the solenoid valve 25 from moving relative to the projection 391 of the second partition 212. Therefore, the present configuration enables to draw air into the canister module 20 and to discharge air from the canister module 20 steadily, while maintaining an airtight property of the first partitioned chamber 221 and the second partitioned chamber 222 from the atmosphere.

Second Embodiment

Figure 4:
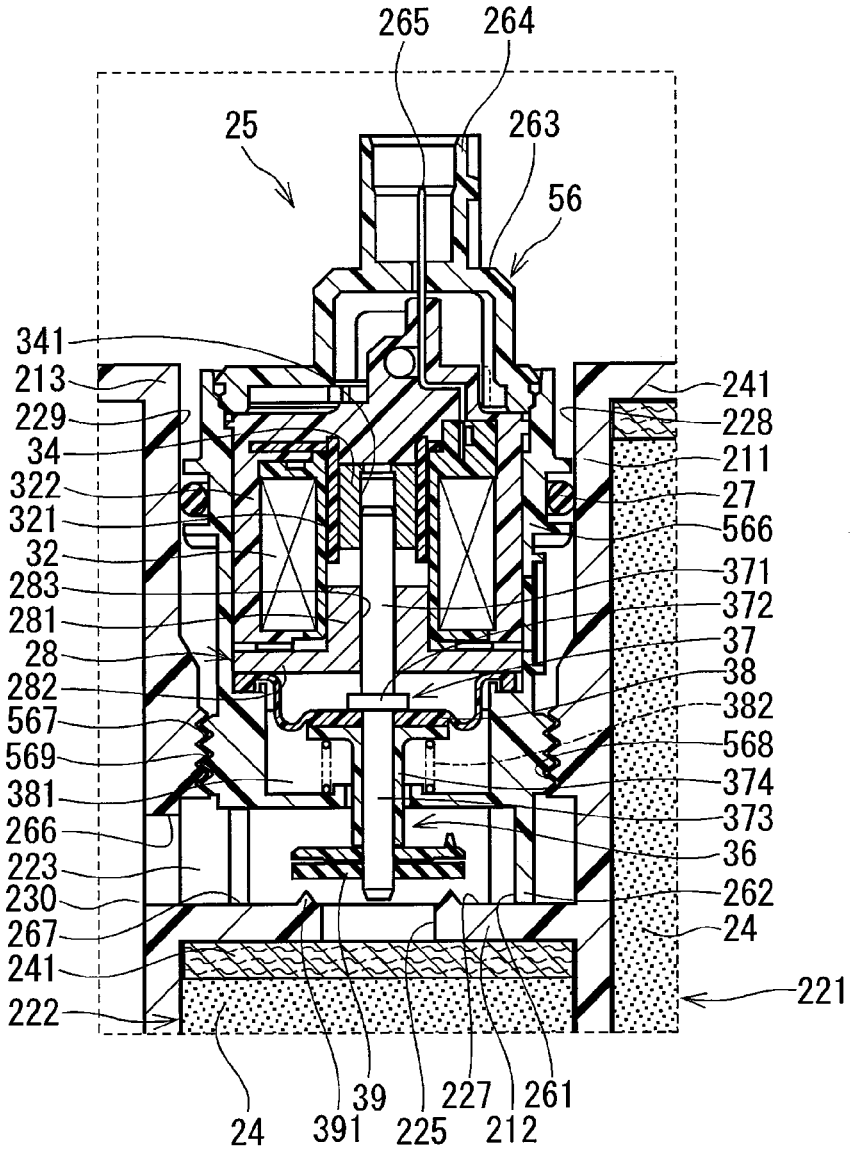
FIG. 4 is an enlarged view showing a canister module according to a second embodiment of the present disclosure.

Subsequently, a canister module according to a second embodiment of the present disclosure will be described with reference to FIG. 4. The second embodiment differs from the first embodiment in the form of the wall, which forms the outer wall of the solenoid valve and the third partitioned chamber.

The canister module according to the second embodiment has a thread groove 567 on an outer wall 566 of a valve housing 56. The wall surface 228 has a thread groove 568 on the side of the third partitioned chamber 223 of the first partition 211. The wall surface 229 has a thread groove 569 on the side of the third partitioned chamber 223 of the outer wall 213. The thread groove 567 of the valve housing 56 is configured to be screwed with the thread groove 568 of the wall surface 228 and the thread groove 569 of the wall surface 229.

In the canister module according to the second embodiment, the thread groove 567 of the valve housing 56, the thread groove 568 of a wall surface 528, and the thread groove 569 of a wall surface 529 are screwed together. In this way, movement of the solenoid valve 25 is regulated relative to the canister housing 21. Thus, the canister module according to the second embodiment with the present configuration produces the operation effects (a) to (e) described in the first embodiment.

Third Embodiment

Figure 5:
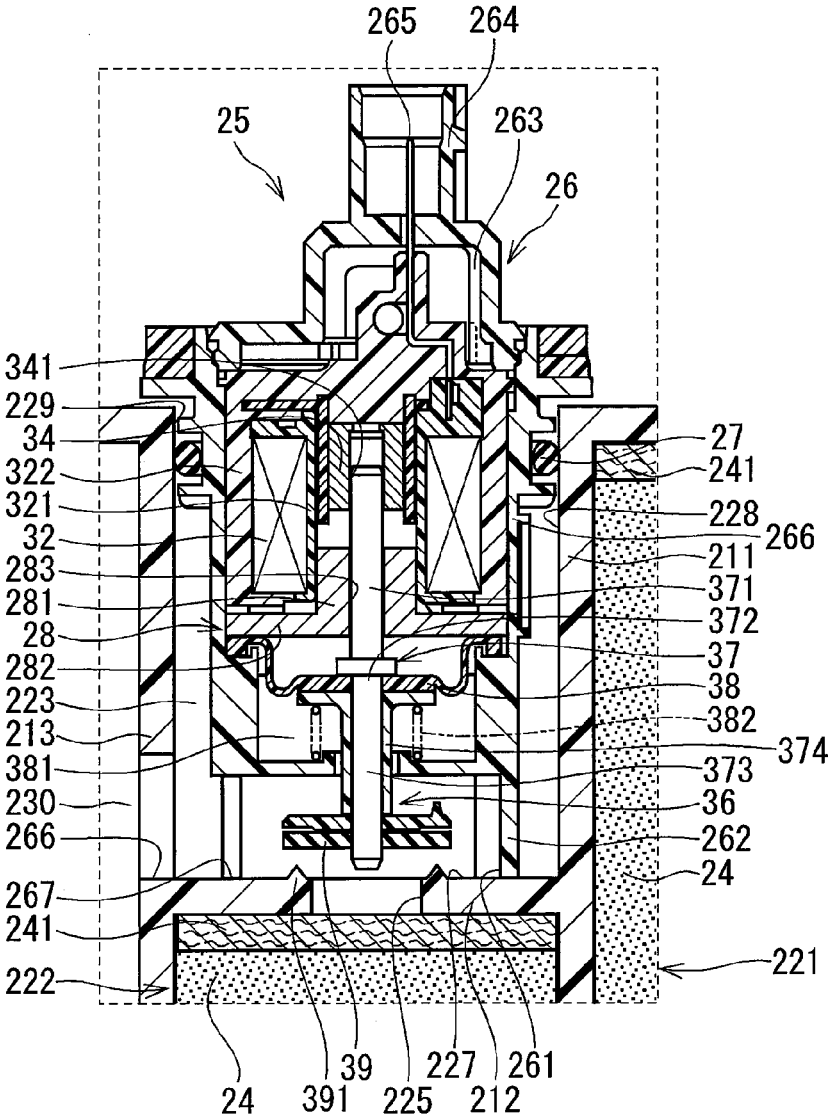
FIG. 5 is an enlarged view showing a canister module according to a third embodiment of the present disclosure.

Subsequently, a canister module according to the third embodiment of the present disclosure will be described with reference to FIG. 5. The third embodiment differs from the first embodiment in that the device does not include the regulating member (regulating unit).

In the canister module according to the third embodiment, the solenoid valve 25 is held in the canister housing 21 by being applied with resilience from the seal member 27, when the solenoid valve 25 is accommodated in the third partitioned chamber 223. Thus, the canister module according to the third embodiment with the present configuration produces the operation effects (a) to (e) described in the first embodiment.

Other Embodiments

In the above-described embodiments, the projection is formed on the periphery of the second partition, which is on the side of the third partitioned chamber and forms the first opening. It is noted that, the projection may be omitted.

In the above-described embodiment, the valve element is configured to make contact with the periphery of the second partition, which is on the side of the third partitioned chamber and forms the first opening, and to move away from the periphery of the second partition. It is noted that, the valve element is not limited to make contact with the periphery of the second partition. The valve element may be configured to make contact with a periphery of the outer wall of the valve housing, which is on the side of the third partitioned chamber and forms the second opening, and to move away from the outer wall of the valve housing.

In the above-described embodiment, the canister adsorption material is formed of activated carbon. The canister adsorption material is not limited to activated carbon and may be formed of other various materials, which are configured to absorb fuel vapor and to release fuel vapor.

The canister module according to the present disclosure is configured to supply fuel vapor, which is caused in the fuel tank, to the internal combustion engine. The canister module includes the canister housing, the atmospheric air passage member, the adsorption material, the valve housing, the valve element, the coil, the moving core, the stationary core, and the seal member. The atmospheric air passage member forms the atmospheric air passage, which is configured to communicate the interior of the canister housing with the atmosphere. The adsorption material is accommodated in the interior of the canister housing and configured to adsorb fuel vapor. The valve housing is equipped in the recessed portion, which is formed in the canister housing. The valve element is accommodated in the interior of valve housing. The moving core is connected to the valve element. The stationary core is configured to draw the moving core with the magnetic field generated by the coil. The seal member is equipped to the radially outside of the valve housing and configured to maintain the airtight property of the recessed portion from the atmosphere.

In the canister module of the present disclosure, the first opening formed in the inner wall of the recessed portion communicates the interior of the canister housing with the recessed portion. In addition, the second opening formed in the inner wall of the recessed portion communicates the atmospheric air passage with the recessed portion. In addition, the valve seat is formed on the periphery of the first opening or the second opening. The valve element is configured to make contact with the valve seat and to be separated from the valve seat to communicate the interior of the canister housing with the atmospheric air passage and to block the interior of the canister housing from the atmospheric air passage.

In the canister module of the present disclosure, the inner wall of the recessed portion, which is formed in the canister housing, has two openings. The first opening communicates the interior of the recessed portion, in which valve housing is accommodated, with the interior of the canister housing, in which the adsorption material is accommodated. In addition, the second opening communicates the atmospheric air passage with the recessed portion. That is, the interior of the canister housing communicates with the atmospheric air passage through the interior of the recessed portion. The seal member is equipped on the radially outside of the valve housing. When the valve housing is accommodated in the recessed portion, the seal member secures the airtight property of the recessed portion from the atmosphere. In addition, the valve element is movable back and forth in the interior of the valve housing. The valve seat is formed on the periphery of the first opening or the second opening. When the valve element makes contact with the valve seat, the interior of the canister housing is blocked from the recessed portion and the atmospheric air passage. When the valve element moves away from the valve seat, the interior of the canister housing communicates with the recessed portion and the atmospheric air passage. With the present configuration, the canister module of the present disclosure with the single seal member enables to secure the airtight property of the interior of the canister housing from the atmosphere. Therefore, the present configuration enables to reduce a portion of the device through which fuel may leak from the interior of the canister housing.

In addition, the present configuration enables to secure the airtight property of the interior of the canister housing from the atmosphere with the single seal member, dissimilarly to a configuration to secure the airtight property of the interior of the canister housing from the atmosphere with multiple seal members. Thus, the present configuration enables to reduce the number of components of the canister module.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure. While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A canister module configured to supply fuel vapor, which is caused in a fuel tank, to an internal combustion engine, the canister module comprising:

a canister housing having a tank passage and a purge passage, the tank passage configured to communicate with the fuel tank, the purge passage configured to communicate with an intake air system, the intake air system configured to supply air-fuel mixture, which is mixture of air and fuel, to the internal combustion engine;

an atmospheric air passage member defining an atmospheric air passage configured to communicate an interior of the canister housing with an atmosphere;

an adsorption material accommodated in the interior of the canister housing and configured to adsorb fuel vapor;

a valve housing located in a recessed portion, which is defined in the canister housing;

a valve element movable in the valve housing;

a coil configured to generate a magnetic field when being energized;

a moving core connected with the valve element and movable in an axial direction of the valve housing;

a stationary core configured to draw the moving core with the magnetic field generated by the coil; and a seal member located on a radially outside of the valve housing and configured to seal the recessed portion airtightly from the atmosphere, wherein the recessed portion is defined with a first inner wall and a second inner wall, the first inner wall has a first opening configured to communicate the interior of the canister housing with the recessed portion, the second inner wall has a second opening configured to communicate the recessed portion with the atmospheric air passage, the first opening or the second opening is defined around a periphery forming a valve seat, and the valve element is configured to make contact with the valve seat and to be spaced from the valve seat to communicate the interior of the canister housing with the atmospheric air passage and to block the interior of the canister housing from the atmospheric air passage.

2. The canister module according to claim 1, further comprising:

a regulating unit configured to regulate change in a relative position of the valve housing to the canister housing.

3. The canister module according to claim 1, wherein the valve housing is screwed to the canister housing.

4. The canister module according to claim 1, wherein the valve seat is projected into the recessed portion.

* * * * *